US007275885B2

(12) United States Patent
Byun

(10) Patent No.: US 7,275,885 B2
(45) Date of Patent: Oct. 2, 2007

(54) COSMETICS BRUSH

(76) Inventor: Young-Chul Byun, 206-1702, UjangsanLotteNakchundaeApt, 1145, Hwagok-dong, Gangseo-Gu, Seoul 157-010 (KR)

( * ) Notice: Subject to any disclaimer, the term of this patent is extended or adjusted under 35 U.S.C. 154(b) by 0 days.

(21) Appl. No.: 10/751,979

(22) Filed: Jan. 7, 2004

(65) Prior Publication Data

US 2007/0177930 A1 Aug. 2, 2007

(30) Foreign Application Priority Data

Dec. 23, 2003 (KR) ..... 10-2003-0095379

(51) Int. Cl.
*A46B 11/04* (2006.01)
*A46B 11/00* (2006.01)

(52) U.S. Cl. ..... 401/280; 401/278; 401/4

(58) Field of Classification Search ..... 401/4, 401/187, 278, 279, 280; 132/298, 299, 307
See application file for complete search history.

(56) References Cited

U.S. PATENT DOCUMENTS 4,906,120 A * 3/1990 Sekiguchi et al. ..... 401/268

6,142,695 A * 11/2000 Byun ..... 401/188 R

* cited by examiner

*Primary Examiner*—David J. Walczak
(74) *Attorney, Agent, or Firm*—Birch, Stewart, Kolasch & Birch, LLP

(57) ABSTRACT

A cosmetics brush for making-up face by applying air pressure generated by push-button to flow out a powdery cosmetics stored in a receptacle type body of the brush to the brush side, which includes the body containing the powdery cosmetics, an operational rod mounted with a plurality of mixing members to agitate and admix the powdery cosmetics in the body when the operational rod moves up and down, a filter mounted on top end of the operational rod to screen fine particles of the powdery cosmetics to allow the powdery cosmetics to flow out through inlet and outlet holes and a powder transfer tube to the brush side in optimum particle status and in an amount to be desired, and another brush for distributing the powdery cosmetics flowed out from the top end of the operational rod on the brush side in a desirable distribution, and the push-button with a locking and releasing function to prevent unexpected flowing-out of the powdery cosmetics when carrying the cosmetics brush with one.

3 Claims, 11 Drawing Sheets

COSMETICS BRUSH

This non-provisional application claims priority under 35 U.S.C. § 119(a) based on Patent Application No. 2003-0095379 filed in Korea on Dec. 23, 2003, the subject matter of which is herein incorporated by reference.

BACKGROUND OF THE INVENTION

1. Field of the Invention

The present invention relates to a cosmetics brush for making-up face by applying air pressure generated by means of push-button to flow out powdery cosmetics (hereinafter referring to as "powder") stored in a receptacle type body of the brush more particularly, to a cosmetic brush including an operational rod mounted with a plurality of mixing members in forms of brush or bar to agitate and admix the powder stored in a body when the operational rod moves up and down, a filter mounted on top end of the operational rod to screen fine particles of the powder to allow the powder to flow out through inlet and outlet holes and a powder transfer tube to the brush side in optimum particle status and in an amount to be desired, and another brush for distributing the powder flowed out from the top end of the operational rod on the brush side in a desirable distribution, and a push-button with a locking and releasing function to prevent accidental movement of the push-button and unexpected flowing-out of the powder when carrying the cosmetics brush with one.

2. Description of the Related Art

Conventional cosmetics brush is typically made in an integration form by combining a brush part and a body part thereof and is used by covering the brush with alternative powdery cosmetics (hereinafter referring to as "powder"). Accordingly, such cosmetics brush which is separately provided with the powder is inconvenient to be portably carried and stored, thereby causing a difficulty in use thereof.

Recently, various cosmetics brushes for powdering face each having a specific structure suitable to receive the powder inside a receptacle type body of the brush and to flow out the powder by applying air pressure are proposed and utilized. For example, Korean Utility Model Reg. No. 253672 disclosed that it has a conventional construction of the cosmetics brush as shown in FIGS. 7 and 8 hereinbelow.

Such construction includes a first body 102 in a pipe form having opened top and bottom ends to receipt the powder 103 inside thereof; a second body 106 coupled on outer side around bottom portion of the first body 102 and having a flowing-out hole 107 on center of top side thereof and a brush 108 connected to the flowing-out hole 107; an up and down transfer shaft 109 moving up and down having a spring 110 coupled to outer side around front end of the shaft 109, the front end being connected to the flowing-out hole 107 of the second body 106 and the spring being supported by the outer side around top end of the flowing-out hole 107; and a top cap 113 coupled on top end of the first body 102 to project and support top end portion of the up and down transfer shaft 109 outward.

With such construction mentioned above, as one attempts to powder face with said brush 100, she (or he) should push the button 112 coupled on top end of the up and down transfer shaft 109 and projecting to top side. Then, the spring 1110 located on front end of the transfer shaft 109 makes the transfer shaft 109 to move up and down. By movement of the transfer shaft 109 to act the front end thereof, the powder 103 received inside the body 102 flows out through a flowing-out hole 107 formed on the second body 106 and is supplied to outside, that is, another brush 108 to conveniently apply the powder 103.

The powder 103 discharged through the flowing-out hole 107 to the brush 108 is introduced into the brush side 108 by directly passing the front end of the up and down transfer shaft 109 through the flowing-out hole 107.

However, since such a conventional cosmetics brush flows out the powder 103 to the brush 108 through the front end of the up and down transfer shaft 109, it has a drawback of not flowing out the powder 103 in a desirable and/or constant amount due to structural restriction of the up and down transfer shaft 109, and an inconvenience in use because the powder 103 easily and occasionally flows out to the brush side 108 even by vibration of the cosmetics brush 100 itself.

Additionally, the above construction which includes a button 112 provided on the top cap 113 with a particular structure always projecting outward by elastic force of the spring 110 has another disadvantage that the button 112 may occasionally move to cause the powder 103 flowing out to the brush side 108 and spoil other things carried when the cosmetics brush 100 contacts with other things carried during carrying and storing it or is subjected to external force. Further, in case of keeping the cosmetics brush in wet places or not using the cosmetics brush for long term, the powder 103 received inside the first body 102 and a residual of the powder 103 in the flowing-out hole 107 become hard by moisture, thereby prohibiting smooth flowing-out of the powder 103.

SUMMARY OF THE INVENTION

It is, therefore, an object of the present invention is to solve the above problems, in particular, to provide a cosmetics brush including an operational rod mounted with a plurality of mixing members in forms of brush or bar to agitate and admix a powdery cosmetics (hereinafter, referring to as 'powder') stored in a body when the operational rod moves up and down, a filter mounted on top end of the operational rod to screen fine particles of the powder to allow the powder to flow out through inlet and outlet holes and a powder transfer tube to the brush side in optimum particle status and in an amount to be desired, and another brush for distributing the powder flowed out from the top end of the operational rod on the brush side in a desirable distribution, and a push-button with a locking and releasing function to prevent accidental movement of the push-button and unexpected flowing-out of the powder when carrying the cosmetics brush with one.

BRIEF DESCRIPTION OF THE DRAWINGS

The above object, features and advantages of the present invention will become more apparent to those skilled in the related art from the following detailed description for preferred embodiments taken in conjunction with the accompanying drawing, in which.

DETAILED DESCRIPTION OF THE PREFERRED EMBODIMENT

The present invention will be described in more detail be reference to the following embodiments which are presented for purpose of illustration and should not be construed to limit the scope of the invention thereto.

Firstly, structural construction of the present invention is described as follows with reference to the accompanying drawings.

Figure 1:
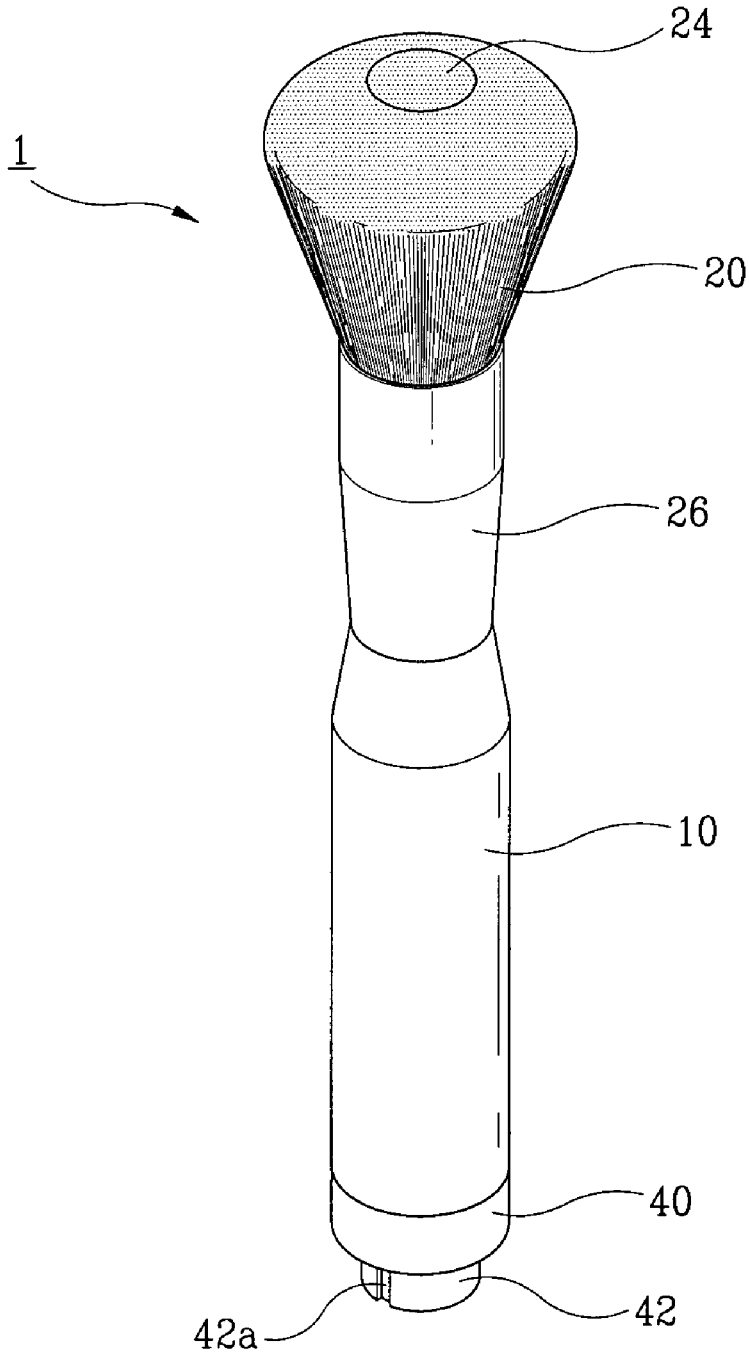
FIG. 1 is a perspective view of an preferred embodiment of a cosmetics brush according to the present invention.
Figure 2:
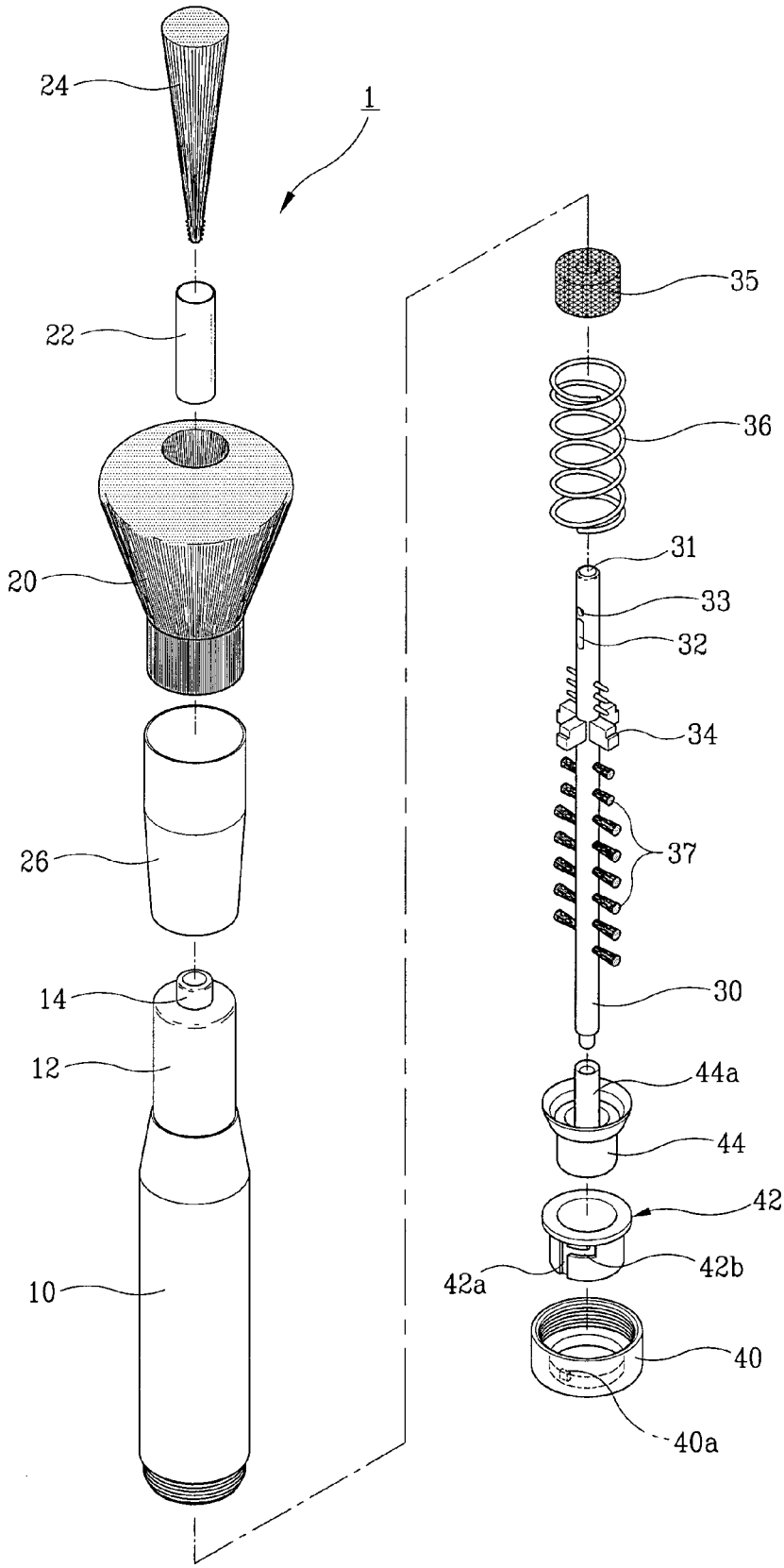
FIG. 2 is an exploded perspective view of the preferred embodiment according to the present invention.
Figure 3A:
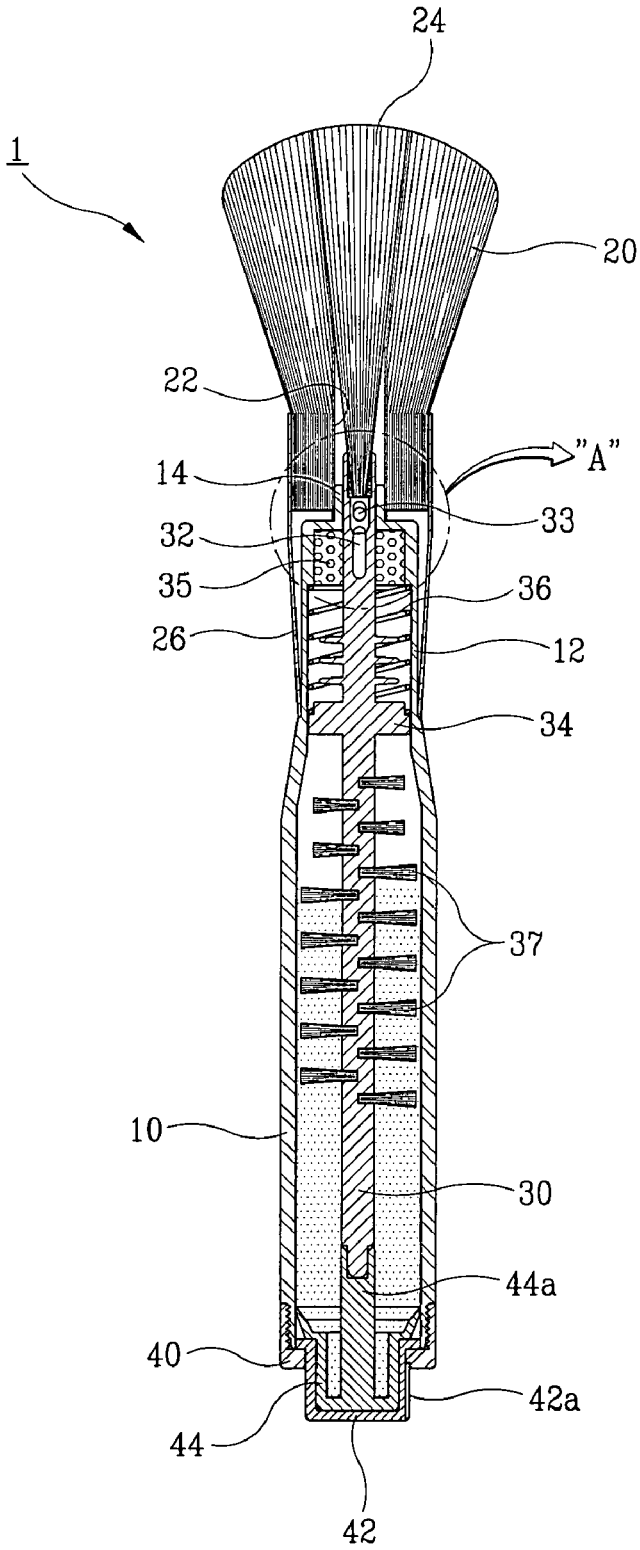
FIG. 3*a* is a sectional view of the preferred embodiment according to the present invention, showing it in an assembly status.
Figure 3B:
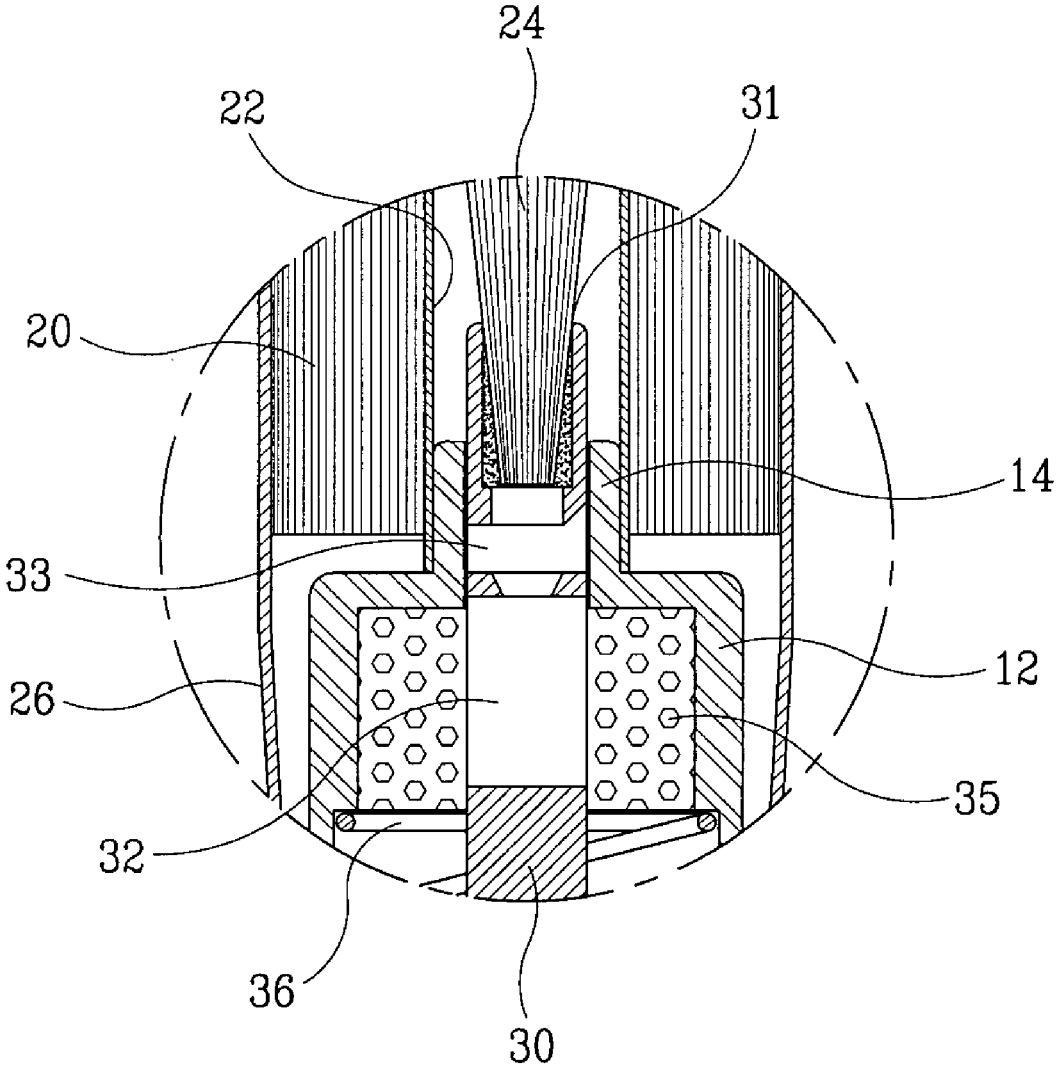
FIG. 3*b* is an enlarged side sectional view for the "A" portion of FIG. 3*a;*
Figure 4A:
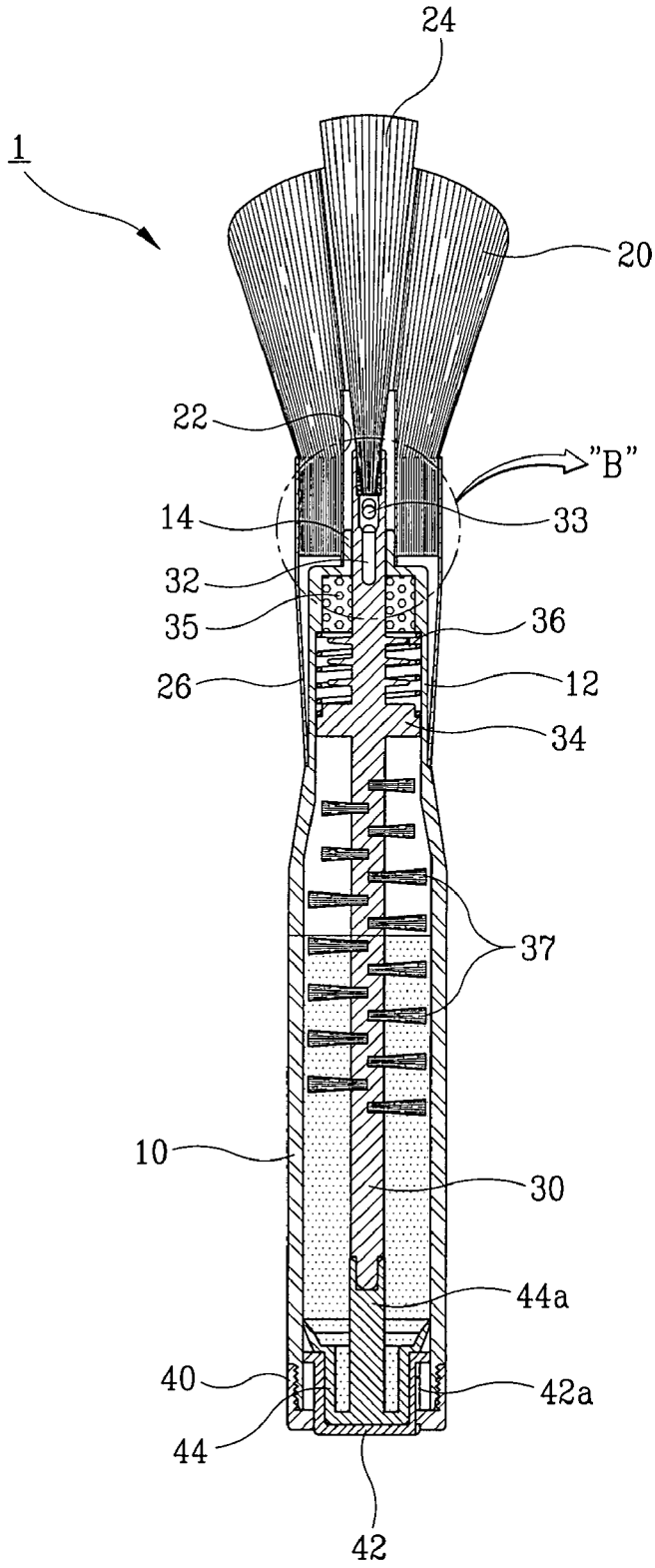
FIG. 4*a* is a sectional view of the preferred embodiment according to the present invention, showing it in use.
Figure 4B:
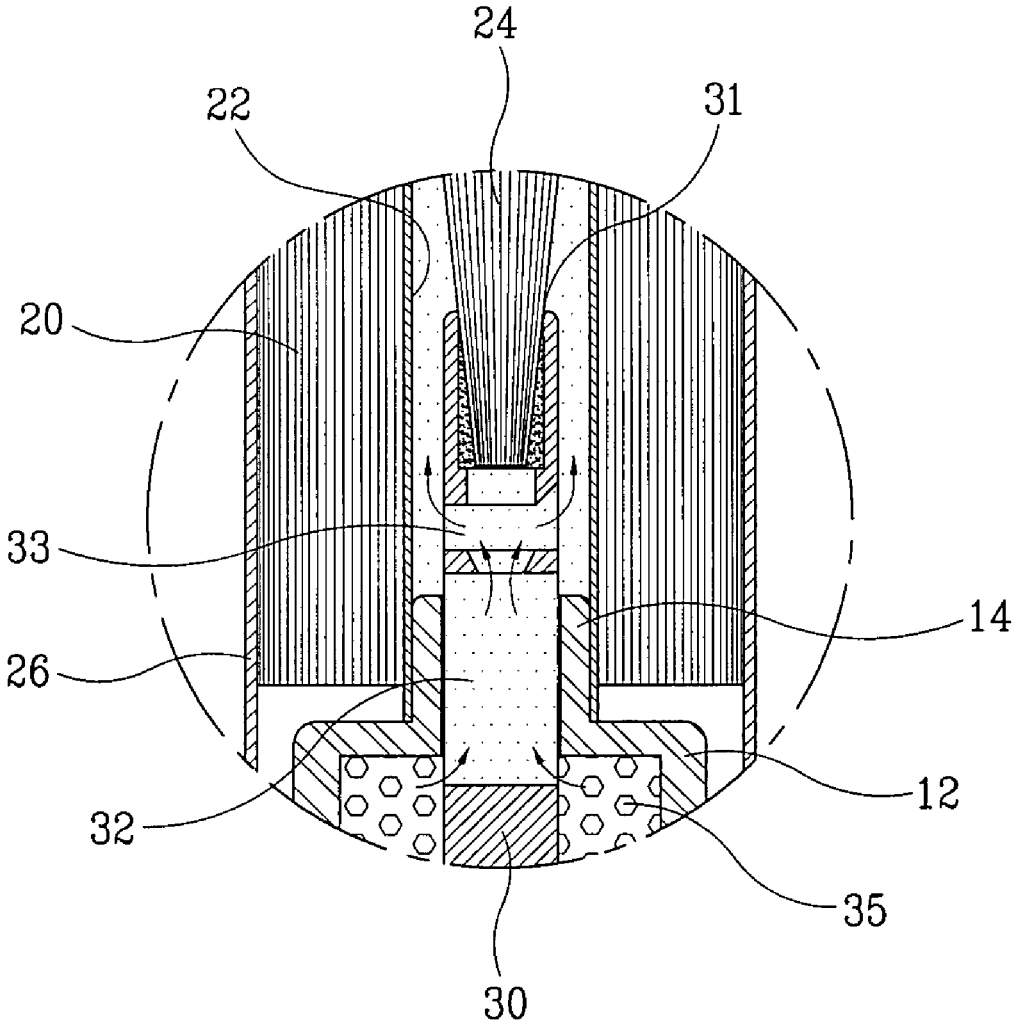
FIG. 4*b* is an enlarged side sectional view for the "B" portion of FIG. 4*a;*

FIG. 1 illustrates a perspective view of a preferred embodiment of the cosmetics brush according to the present invention. FIG. 2 is an exploded perspective view of the above preferred embodiment. FIG. 3*a* is a sectional view of the preferred embodiment according to the present invention, showing it in an assembly status and FIG. 3*b* is an enlarged side sectional view for the "A" portion of FIG. 3*a*. FIG. 4*a* is a sectional view of the preferred embodiment according to the present invention, showing it in use and FIG. 4*b* is an enlarged side sectional view for the "B" portion of FIG. 4*a*.

The cosmetics brush 1 according to the present invention includes an operational rod 30 built in a body 10 to move up and down by pushing a push-button 42 to apply pressure to the body 10, the operational rod 30 making cosmetic powder to flow out through an inlet hole 32 and an outlet hole 33 and a powder transfer tube 22 then to another brush side (brush portion) 20 in a constant amount and, at the same time, running down and being returned to original position thereof by elastic force of a spring 36 mounted on top portion of the operational rod 30. The outlet hole 33 is closed by a supporting member 14 for the operational rod to prevent flowing-out of the powder.

By pushing and releasing the push-button 42, the operational rod 30 can move up and down to freely and conveniently control flowing-out and blocking of the powder to the brush side 20 through the inlet hole 32 and the outlet hole 33.

The inventive cosmetics brush 1 has a specified construction that it further includes a clip fitting member 12 having a brush clip 26 fixed with the brush 20 on top portion of the body 10 and the supporting member 14 for the operational rod to attempt fixture of the powder transfer tube 22 formed inside the brush 20 on top portion of the clip fitting member 12 and to support top portion of the operational rod 30.

Inside the body 10, the operational rod 30 is fitted and a distributional brush fitting member (inner brush fitting member) 31 is formed to be fitted and fixed with a distributional brush 24 mounted in the powder transfer tube 22, and the inlet hole 32 and the outlet hole 33 are formed inside the supporting member 14 for the operational rod.

Around top end of the operational rod 30 having the inlet hole 32, a filter 35 and a spring 36 are together fitted to be located and built inside the clip fitting member 12, thereby being supported by a hook threshold 34 formed on top portion of the operational rod 30.

Figure 5:
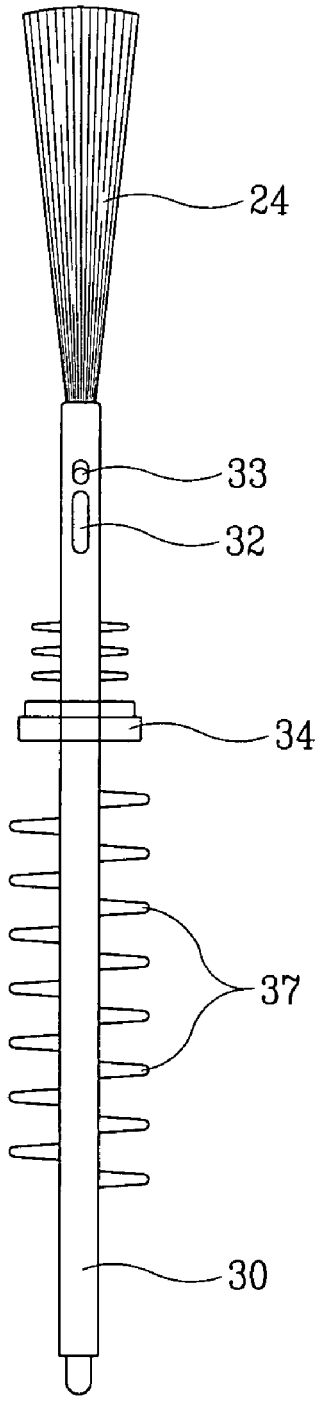
FIG. 5 is an extracted front view of an operational rod of another preferred embodiment according to the present invention.

The multiple mixing members 37 are spaced from middle portion of the operational rod 30 by desirable intervals in vertical downward direction to admix the powder received in the body 10 when the operational rod 30 moves up and down. Each of the mixing members 37 may be formed by fitting a brush to the member as shown in FIGS. 1 to 4 or, optionally, formed to be protruded from the operational rod 30 in a profile shape in a process of forming the operational rod 30, as shown in FIG. 5, if it is required by manufacturers.

On bottom end portion of the operational rod 30, an air compression cap 44 formed with a supporting bar 44*a* is fitted inside the push-button 42, the supporting bar 44*a* being coupled to the bottom end of the operational rod 30. A bottom cap 40 enclosing outer side of the push-button 42 is thread-coupled on bottom end portion of the body 10.

Further, a vertical movement groove 42*a* and a horizontal hook groove 42*b* are formed around one side of the push-button 42. On inner one side of the bottom cap 40, a protrusion 40*a* is formed. When the vertical movement groove 42*a* formed on the push-button 42 connects to the protrusion 40*a* formed on the bottom cap 40, the vertical movement groove 42*a* can move up and down to blow compressed air into the body 10. The push-button 42 which is able to be locked and released cannot act when the protrusion 40*a* is engaged into the horizontal hook groove 42*b*.

The cosmetics brush 1 of the present invention having such construction described above will be more understood with reference to the following description for an assembly of the cosmetics brush.

First, the operational rod 30 has a plurality of mixing members 37 as well as a plurality of hook thresholds 34 and is formed with the inner brush fitting member 31 and the inlet hole 32 and the outlet hole 33 on top end portion thereof. The operational rod 30 is also mounted with the spring 36 and the filter 35 by fitting both of them on the top end portion of the operational rod 30. Then, lower portion of the operational rod 30 is fitted into the body 10 by inserting the top end of the operational rod 30 inside the supporting member 14 to support the operational rod 30. At the same time, bottom end of the operational rod 30 is fitted into the supporting bar 44*a* formed on middle portion of the air compression cap 44 which is inserted into the pushbutton 42. After the protrusion 40*a* formed on a bottom cap 40 is matched with the vertical movement groove 42*a* formed around the push-button 42, the bottom cap 40 is thread-coupled to the bottom end portion of the body 10. As a result, the operational rod 30 is completely installed inside the body 10.

Subsequently, the distributional brush fitting member 31 protruded from the top end portion of the operational rod 30 through the supporting member 14 formed on the bottom end portion of the body 10 is fitted with the distributional brush 24. Following that, the powder transfer tube 22 is fitted and secured on outer side of the supporting member 14 around outer side of the inner brush fitting member 31 to ensure the powder to flow out through between the distributional brush 24 and the powder transfer tube 22.

After then, by inserting bottom end portion of the brush clip 26 coupled with the brush 20 on outer side of the clip fitting member 12, an assembly of the present inventive cosmetics brush 1 is completed.

Practical use and functional effect of the cosmetics brush with such construction described above will be illustrated as follows.

As shown in FIGS. 3*a* and 3*b*, the powder is received inside the body 10 having the operational rod 30 according to the present invention and the powder outlet hole 33 located on the top end of the operational rod 30 is positioned inside the supporting member 14 in a closed state.

In order to receive the powder and flow out the powder to the brush side 20 when the outlet hole 33 is in the closed state, the push-button 42 protruded from the bottom end portion of the body 10 should be forced toward the body side 10 to move the operational rod 30 up and down. At this time, the inside of the body 10 is compressed by the air compression cap 44 coupled into the push-button 42 to instantly push the powder contained in the body 10 into the powder inlet hole 32 on the top end portion of the operational rod 30.

Additionally, the powder pushed into the inlet hole 32 passes through the filter 35 on the top end portion of the clip fitting member 12 before flowing into the inlet hole 32 to separate lump and/or impurities out of the powder and to flow only fine powdery particles into the inlet hole 32.

By fully pressing the push-button 42 to the body side to make the best of moving up the operational rod 30, the outlet hole 33 formed on the top end portion of the operational rod 30 gets rid of the inside of the supporting member 14 for the operational rod, is protruded toward top portion then opened (see FIGS. 4*a* and 4*b*).

As described above, the powder flowed into the inlet hole 32 through the outlet hole 33 instantly flows out between the powder transfer tube 22 and the distributional brush 24 and the distributional brush 24 serves to distribute the flowed powder to the brush side 20 in a desirable distribution.

Continuously, when the push-button 42 is released out of a pressing power applied to the body side 10, the operational rod 30, the air-compression cap 44 and the push-button 42 can be returned to its original condition by the elastic force of the spring 36 supported by the hook threshold 34 of the operational rod 30.

Accordingly, by repeatedly conducting the pushing/releasing actions for the push-button 42, the powder contained in the body 10 can be flowed outside to allow the make-up.

As described above, if the operational rod 30 moves up and down, not only the powder contained in the body 10 flows out to the brush side 20, but also the mixing members 37 mounted in the operational rod 30 moves together with the operational rod 30 and serve to admix the powder inside the body 10. As a result, even though the powder makes harden due to moisture and/or other circumstance conditions, the powder can be finely broken and uniformly blended for further use.

Meanwhile, since the push-button 42 coupled to the lower portion of the body 10 can move up and down when the vertical movement groove 42*a* connects the protrusion 40*a*, the push-button 42 is used as the powder is applied. On the contrary, in order to control action of the push-button 42, the protrusion 40*a* is located within the horizontal hook groove 42*b* by turning the push-button 42 in one direction. In this connection, up and down movement of the push button is controlled to result in preventing the powder from flowing out. Accordingly, the flowing out of the powder is blocked by external force when the cosmetics brush is portably carried.

Figure 6A:
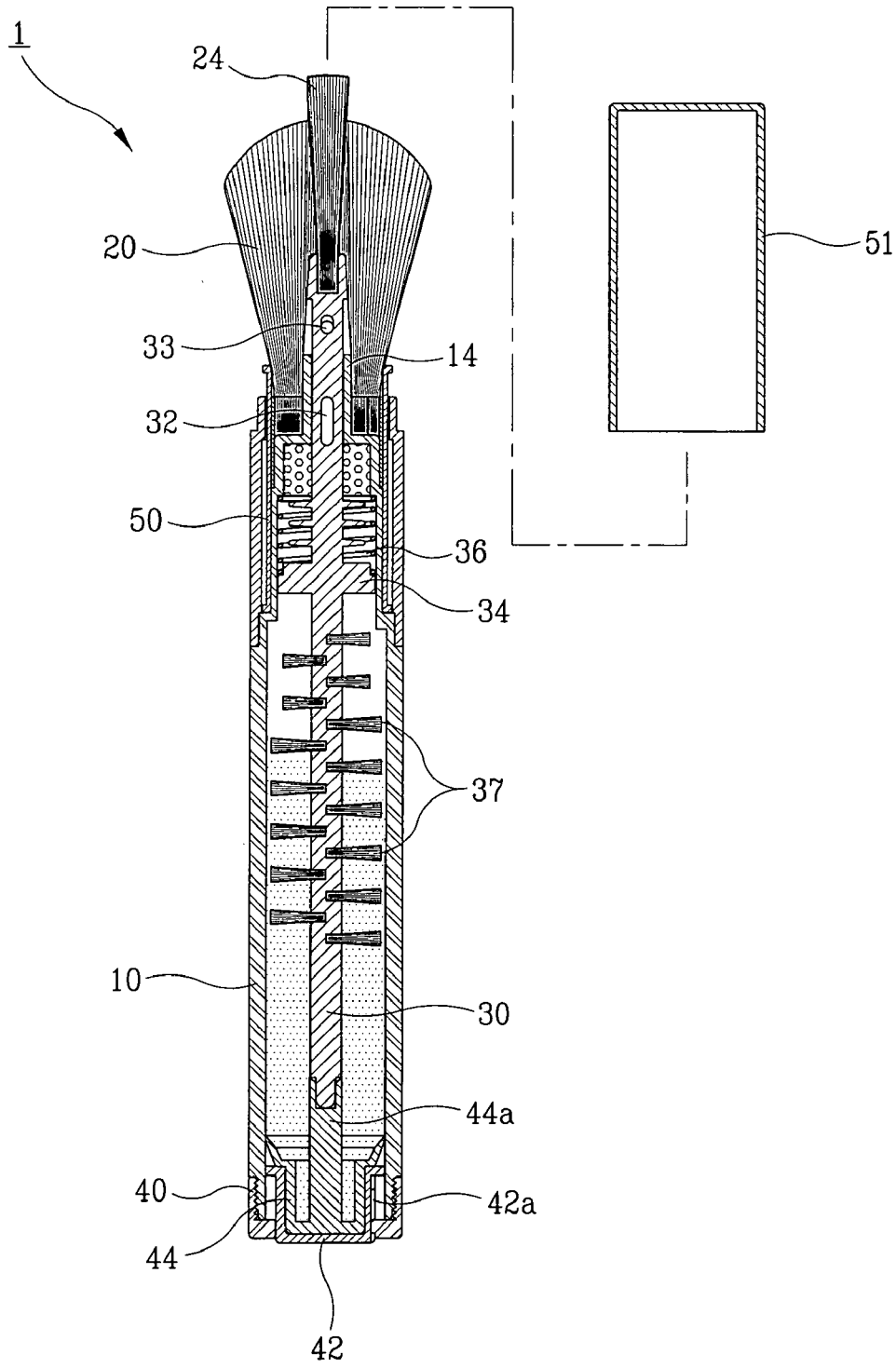
FIG. 6*a* is a view of another preferred embodiment of the cosmetics brush with cap according to the present invention, showing it after opening the cap.
Figure 6B:
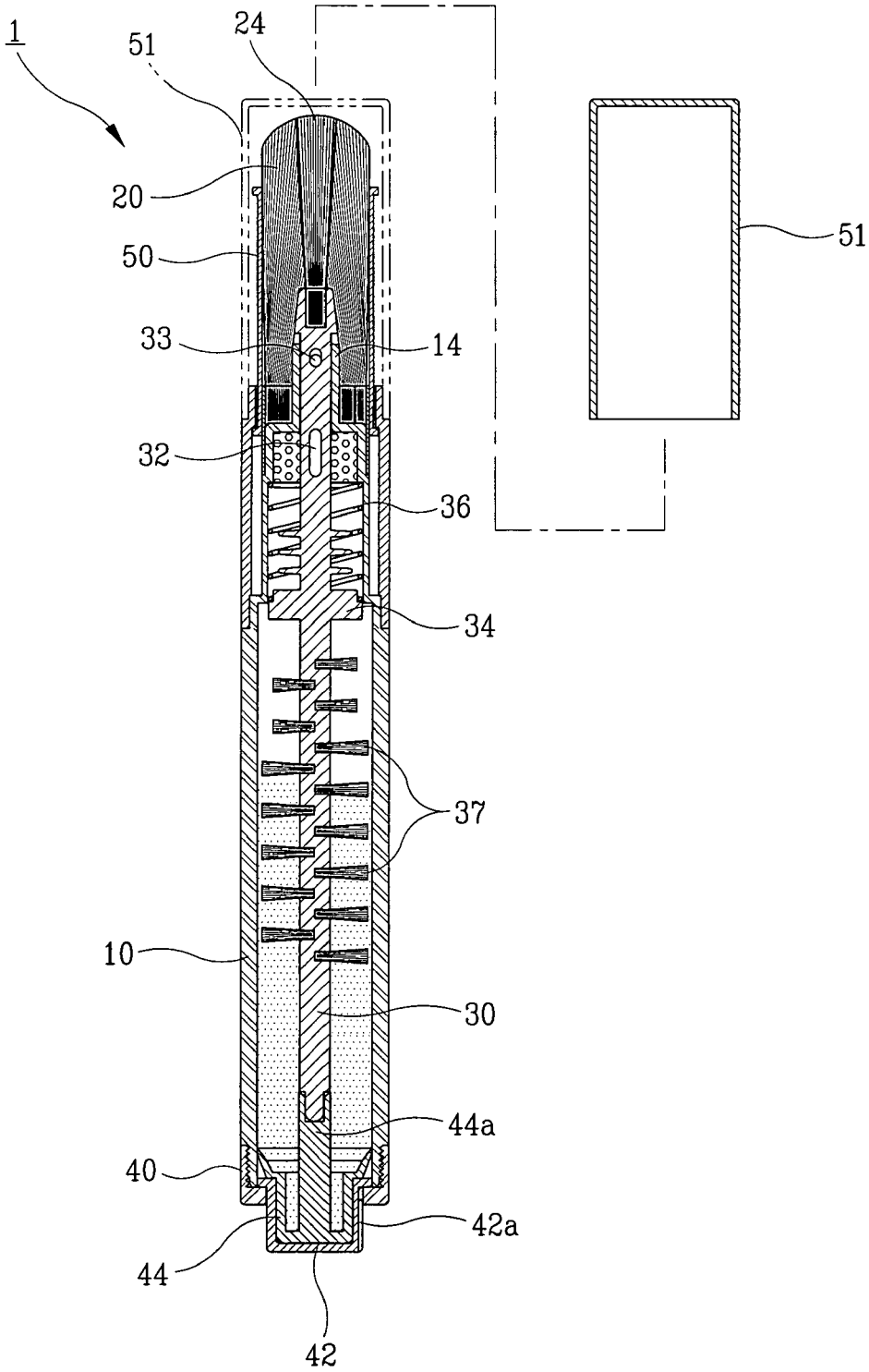
FIG. 6*b* is another view of the preferred embodiment of the cosmetics brush with cap according to the present invention, showing it after closing the cap.
Figure 7:
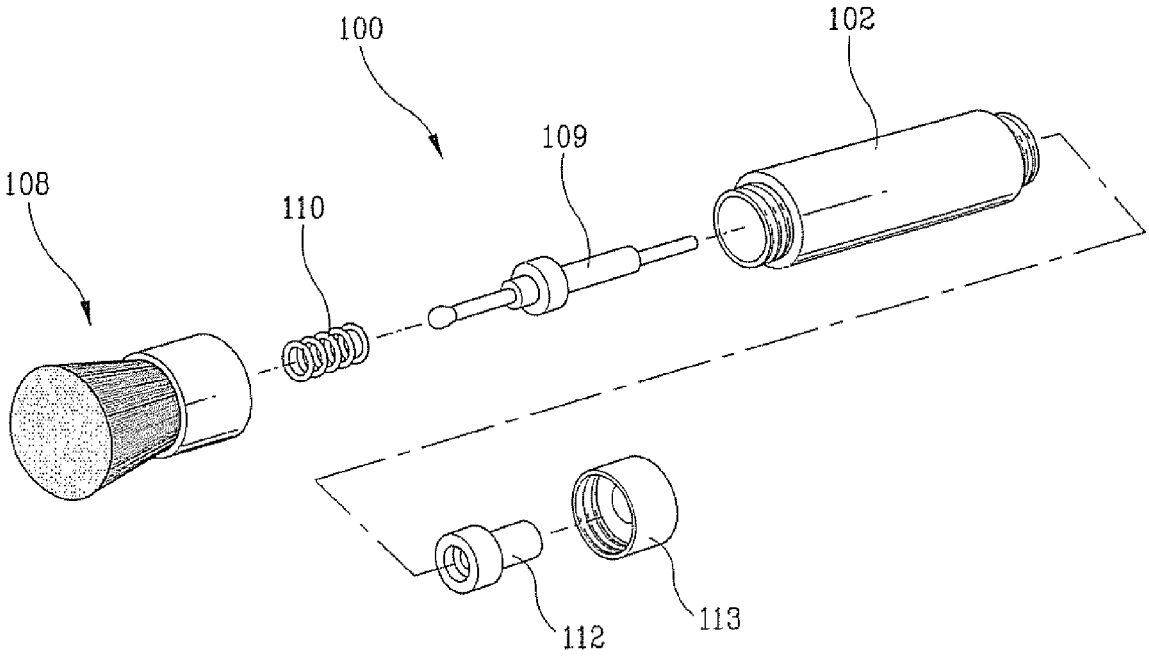
FIG. 7 is an exploded perspective view of a conventional cosmetics brush.
Figure 8:
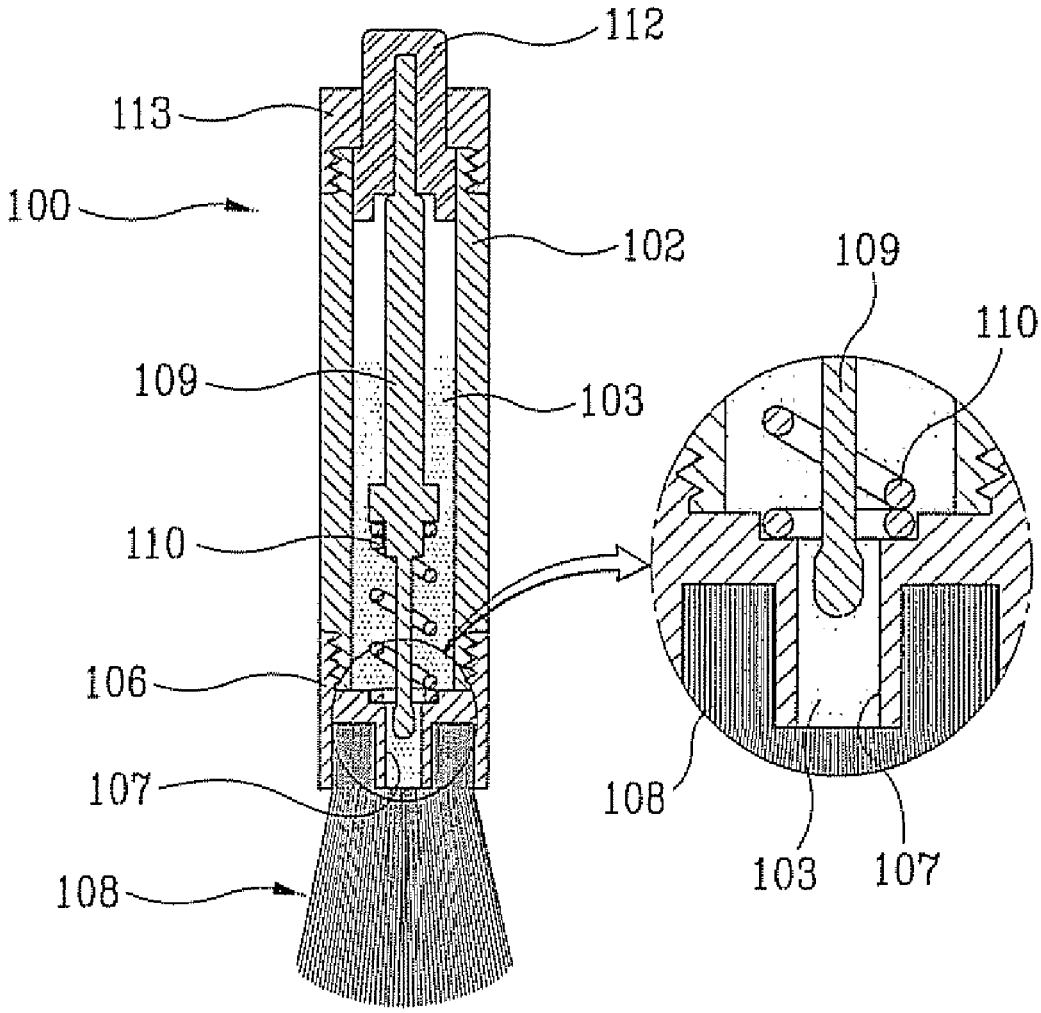
FIG. 8 is an assembled sectional view of the cosmetics brush in FIG. 7.

FIGS. 6*a* and 6*b* illustrate another preferred embodiment of the cosmetics brush according to the present invention.

Such embodiment includes a sliding type brush protection cover 50 and a lid 51 to enclose upper portion of the brush 20 in order to protect lateral sides of the brush 20 in case of not using the powder but only carrying and storing in the brush, instead of the cosmetics brush according to the first embodiment. Such cosmetics brush 1 having the protection cover 50 and the lid 51 also adapts the construction substantially identical to that of the first embodiment so that it accomplishes the same effect corresponding to the one by the first embodiment.

As described above, the cosmetic brush of the present invention including the operational rod mounted with a plurality of mixing members to agitate and admix the powder has advantages that it can easily and uniformly blend the powder hardened due to moisture or other impurities; allow the powder flowing out by the distributional brush at top end of the operational rod to be uniformly distributed; and prevents the unexpected flowing out of the power caused from error in operation of the push-button by adding a movement control device on the push-button.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cosmetics brush including:

a body coupled with a brush portion at top portion of the body, an operational rod built inside the body, and a pushbutton formed on lower portion of the body to flow out powder contained inside the body under pressure to the brush side by pressing the push-button; wherein it further comprises, a clip fitting member formed on the top portion of the body which is fitted with a brush clip having a distributional brush, a powder transfer tube and the brush portion, an inner brush fitting member and an inlet hole and an outlet hole are formed at top end portion inside the body, and an operational rod having a filter supported by a hook threshold, a spring and a plurality of mixing members to admix the powder in the body around outer side of the operational rod, said operational rod being fitted and supported in a supporting member at top end portion while being fitted and secured in an air compression cap coupled to the push-button at bottom end portion thereof, and said push-button being coupled to the body by means of bottom cap.

2. The cosmetics brush of claim 1, wherein the push-button includes a vertical movement groove and a horizontal hook groove around thereof to make and/or control up and down movement of the operational rod.

3. The cosmetics brush of claim 1, wherein the mixing members are protruded from the operational rod in a form of profile.

* * * * *